US005299178A

United States Patent [19]

Belik

[11] Patent Number: 5,299,178

[45] Date of Patent: Mar. 29, 1994

[54] CLOCK

[76] Inventor: Jaroslav Belik, 1610 Mulcahy, Rosenberg, Tex. 77471

[21] Appl. No.: 102,886

[22] Filed: Aug. 6, 1993

[51] Int. Cl.[5] ..... G04B 19/20; G04C 21/00

[52] U.S. Cl. ..... 368/76; 368/77; 368/223

[58] Field of Search ..... 368/76–78, 368/80, 220, 223, 228, 231–235

[56] References Cited

U.S. PATENT DOCUMENTS

| | | | |
|---|---|---|---|
| 219,040 | 8/1879 | Treat . | |
| 2,221,413 | 11/1940 | Schanz . | |
| 2,952,967 | 9/1960 | Nussle . | |
| 3,024,590 | 3/1962 | Wtnne . | |
| 3,852,949 | 12/1974 | Catler . | |
| 3,956,879 | 5/1976 | Bailey . | |
| 4,103,484 | 8/1978 | Bailey . | |
| 4,161,098 | 7/1979 | Ingendahl . | |
| 5,199,006 | 3/1993 | Ferrara | 368/76 |

*Primary Examiner*—Vit W. Miska
*Attorney, Agent, or Firm*—Harrison & Egbert

[57] ABSTRACT

A clock having a motor with a shaft extending outwardly therefrom, a sprocket affixed to the shaft, a clock dial positioned adjacent the sprocket and having minute indica displayed thereon, a plurality of hour members being interconnected together in the form of a continuous band, and a minute hand interconnected to the sprocket such that the minute hand moves in relation to the movement of the sprocket. The continuous band extends over a portion of the sprocket such that the plurality of hour members move relative to a movement of the sprocket. The sprocket is a geared member having a plurality of teeth extending outwardly therefrom for the purpose of engaging a portion of the continuous band. Each of the plurality of hour members is equally spaced from an adjacent hour member. Each of the plurality of hour members is connected by a chain section to an adjacent hour member. The sprocket engages the chain section between the hour members.

20 Claims, 3 Drawing Sheets

CLOCK

TECHNICAL FIELD

The present invention relates to devices for indicating time. More particularly, the present invention relates to clocks, and similar items, in which an indication of time is produced on a display.

BACKGROUND ART

Clocks have been used throughout the years for the telling of time. Clocks have taken on a wide variety of configurations over the years. Water clocks, sundials, mechanical clocks, spring clocks, and similar items have been used to determine time. Often, these clocks have taken on a very distinctive decorative appearance. Many clocks have an appearance that is aesthetically pleasing and also which accurately produces an indication of time.

Conventional clocks have a plurality of hour indicia arranged in a generally circular pattern around the central axis of a clock mechanism. Minute hands and hour hands are employed so as to properly determine the time of day. The minute, hour, and second hands rotate about the central shaft of the motor driving the clock. The position of the hands, relative to the hour indicia, allows one to properly determine the time of day. Throughout the years, a wide variety of other mechanisms have also served the purpose of determining time.

It is an object of the present invention to provide a clock that has a decorative and interesting appearance.

It is another object of the present invention to provide a clock that accurately displays time.

It is still a further object of the present invention to provide a decorative clock which allows the time to be easily determined.

It is still a further object of the present invention to provide a clock that is easy to manufacture, relatively inexpensive, and easy to use.

These and other objects and advantages of the present invention will become apparent from a reading of the attached specification and appended claims.

SUMMARY OF THE INVENTION

The present invention is a clock that comprises a motor having a shaft extending outwardly therefrom, a sprocket affixed to the shaft, a clock dial positioned adjacent to the sprocket and having minute indicia displayed thereon, a plurality of hour members being interconnected together in the form of a continuous band, and a minute hand interconnected to the sprocket such that the minute hand moves in relation to the motion of the sprocket. The continuous band extends over a portion of the sprocket. The continuous band extends over a portion of the sprocket such that the plurality of hour members move relative to a movement of the sprocket.

The motor is positioned behind the clock dial and the shaft extends outwardly of the clock dial generally perpendicular to a surface of the clock dial. The motor is drivingly connected to the shaft so as to rotate the shaft at the rate of one-half revolution per minute.

The sprocket is a geared member having a plurality of teeth extending outwardly therefrom. These teeth serve to engage the continuous band. An indented receiving area is formed in the geared member so as to conform to a shape of the hour members. The sprocket has a pair of opposing indented receiving areas formed in the geared member. Each of these receiving areas has a generally semi-circular configuration.

In the preferred embodiment of the present invention, each of the hour members has a discoidal configuration. The semicircular configuration of the receiving area serves to receive an edge of the hour members.

The clock dial has a generally semi-circular configuration. The minute indicia extend around a periphery of the semi-circular configuration.

Each of the plurality of hour members is spaced from an adjacent hour member. Each of the plurality of hour members is connected by a chain section to an adjacent hour member. The chain section engages the teeth of the sprocket. In the preferred embodiment of the present invention, each of the plurality of hour members is a disk with an hour indicia displayed on a surface thereof. A total of twelve hour members are equally spaced apart along the continuous band. Each of the hour members has a center which is spaced from a center of an adjacent hour member by a distance corresponding to one-half the circumference of the sprocket.

The minute hand is affixed to the sprocket and extends outwardly perpendicular to the shaft. The minute hand extends centrally through one of the indented receiving areas. A second minute hand may extend centrally through the other of the indented receiving areas. The minute hands are separated by 180 degrees.

In an alternative embodiment of the present invention, the geared member has a pair of teeth extending outwardly from a face of the geared member. These teeth are spaced 180 degrees from each other. The plurality of hour members has a triangular configuration. Each of the hour members has a corner connected by a link to a corner of an adjacent hour member. A notch is formed adjacent to each of these corners. The notch serves to engage the teeth of the geared member. In this embodiment of the present invention, another corner of the triangular configuration serves as the minute hand. Each of the pair of teeth has an hourglass configuration. The center of the hourglass configuration serves to receive a portion of the continuous band.

DETAILED DESCRIPTION OF THE INVENTION

Figure 1:
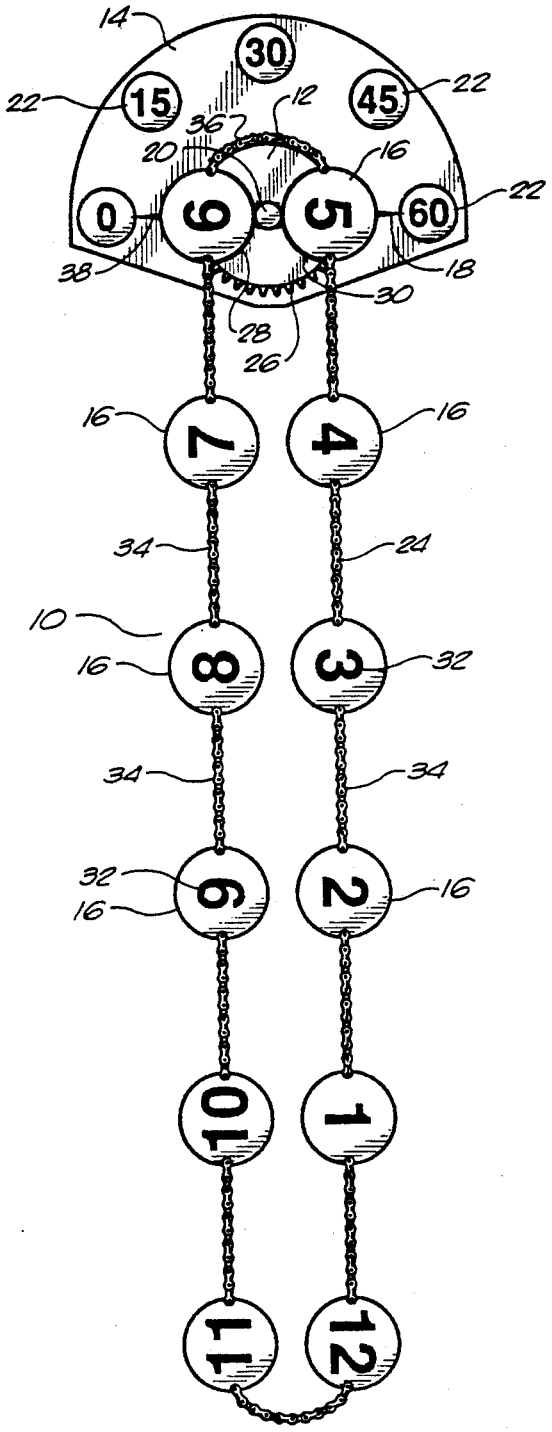
FIG. 1 is a frontal elevational view of the clock in accordance with the preferred embodiment of the present invention.

Referring to FIG. 1, there is shown at 10 the clock in accordance with the preferred embodiment of the present invention. The clock 10 of the present invention includes a motor (not shown), a sprocket 12, a clock dial 14, a plurality of hour members 16, and a minute hand 18. As can be seen, the sprocket 12 is affixed to a shaft 20. The clock dial 14 is positioned behind and adjacent to the sprocket 12. The clock dial 14 includes minute indicia 22 thereon. The plurality of hour members 16 are interconnected together in the form of a continuous band 24. This continuous band 24 extends over a portion of the sprocket 12 such that the plurality of hour members 16 move relative to a movement of the sprocket 12. The minute hand 18 is interconnected to the sprocket 12 such that the minute hand 18 moves in relation to a movement of the sprocket 12.

As can be seen in FIG. 1, the sprocket 12 has a plurality of teeth 26 which extend radially outwardly along the circumference of the sprocket 12. The sprocket 12 includes a first indented receiving area 28 and a second indented receiving area 30. As can be seen, these indented receiving areas 28 and 30 conform to the shape of the hour members 16. The indented receiving areas of the sprocket 12 are placed in opposing positions, approximately 180 degrees apart. As can be seen, the indented receiving areas 28 and 30 have a generally semi-circular configuration.

The sprocket 12 is affixed to the shaft 20 and extends outwardly in parallel relationship to the clock dial 14. As will be described hereinafter, the motor will rotate the shaft 20 at one-half revolution per minute. The sprocket 12 will rotate in relation to the movement of the shaft 20. The teeth 26 of the sprocket 12 serve to engage portions of the continuous band 24 on which the hour members 16 are affixed. As the sprocket 12 rotates, the receiving areas 28 will engage the outer edges of the discoidal-shaped hour members 16. As the sprocket rotates, each of the hour members 16 will move in correspondence with the sprocket so as to be indicative of the time of day.

Each of the hour members 16 has hour indicia 32 printed thereon. The hour indicia is, conventionally, the referenced hour of the day. In the preferred embodiment of the present invention there are a total of twelve hour members sequentially numbered from one to twelve. In alternative embodiments of the present invention, it is possible to have a continuous band 24 in which the hour indicia are numbered on the twenty-four hour scale. Under such circumstances, a total of twenty-four hour members 16 would be required.

In FIG. 1, it can be seen that each of the hour members 16 is spaced from an adjacent hour member. A chain section 34 connects each of the hour members 16 to an adjacent hour member. This chain section 34 can take on the form of a bicycle chain, or similar chain. Typically, the chain 34 will have openings for engaging the teeth 26 of the sprocket 12. As can be seen at 36 of FIG. 1, a portion of the chain linkage is illustrated as engaging the teeth 26 of sprocket 12.

As can be seen, each of the plurality of hour members 16 has a discoidal shape. As used herein, the term "discoidal" can be circular, semi-circular, spherical, or a related shape. Depending on the shape of the hour members 16, the receiving areas 28 and 30 will take on a shape which conforms to at least a portion of the shape of the hour members 16. Each of the plurality of hour members is equally spaced from an adjacent hour member along the continuous band 24. Each of the hour members 16 has a center which is spaced from a center of an adjacent hour member by a distance corresponding to one-half the circumference of the sprocket 12. This allows the clock 10 of the present invention to properly tell time and to produce consistent results throughout the movement of the sprocket 12.

The minute hand 18 is affixed to the sprocket 12 and extends outwardly perpendicular to the shaft 20. The minute hand 18 extends centrally through the receiving area 30 of the sprocket 12. The minute hand also includes a second portion 38 that extends centrally through the other receiving area 28. The minute hands 18 and 38 are separated by 180 degrees.

As can be seen in FIG. 1, the time which is indicated is either 6:00 or 5:60. The receiving area 28 of sprocket 12 receives the hour member having the hour indicia "6". The minute hand corresponding to receiving area 28 points to the numeral "0" on the clock dial 14. Similarly, the receiving area 30 receives the hour member 16 having hour indicia "5" thereon. The minute hand 18 is pointing toward the minute indicia "60". As a result, it can be seen that the clock 10 allows time to be easily determined.

Figure 2:
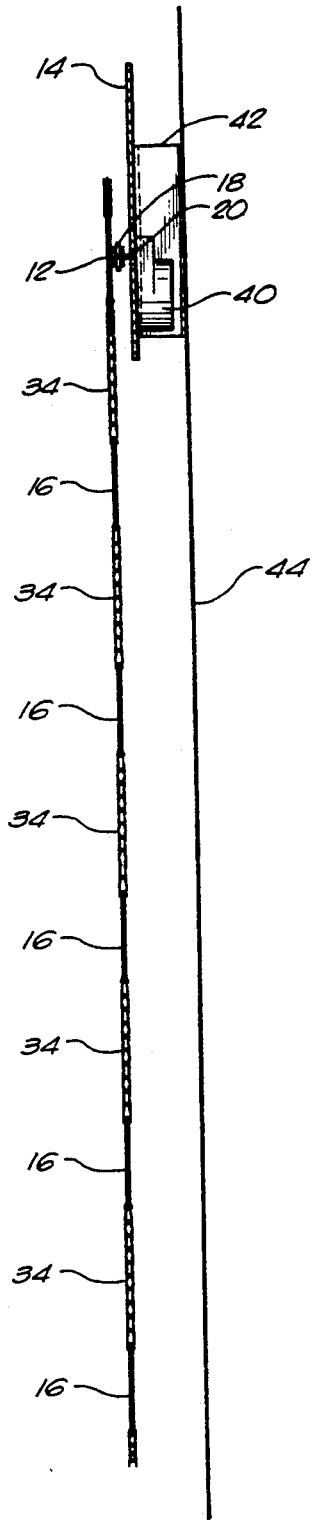
FIG. 2 is a side elevational view showing the clock in accordance with the preferred embodiment of the present invention.

FIG. 2 shows that the motor 40 is positioned within a housing 42 behind the clock dial 14. The housing 42 is mounted on a wall 44, for purposes of illustration. The shaft 20 extends outwardly from the motor 40 and outwardly from the housing 42. The shaft 20 extends perpendicular to the clock dial 14. The sprocket 12 is mounted on an end of the shaft 20. The minute hand 18 is affixed to the sprocket 12 and/or to the shaft 20. It is only necessary that the minute hand 18 move in relation to the rotation of the shaft 20.

In FIG. 2, it can be seen that the hour members 16 extend downwardly from the sprocket 12. The hour members 16 extend in generally parallel relationship to a surface of the wall 44. The configuration of the sprocket 12, in parallel relationship to the clock dial 14, will also serve to maintain the hour members 16 in this parallel relationship. The chain sections 34 are illustrated as extending between each of the hour members 16.

Figure 3:
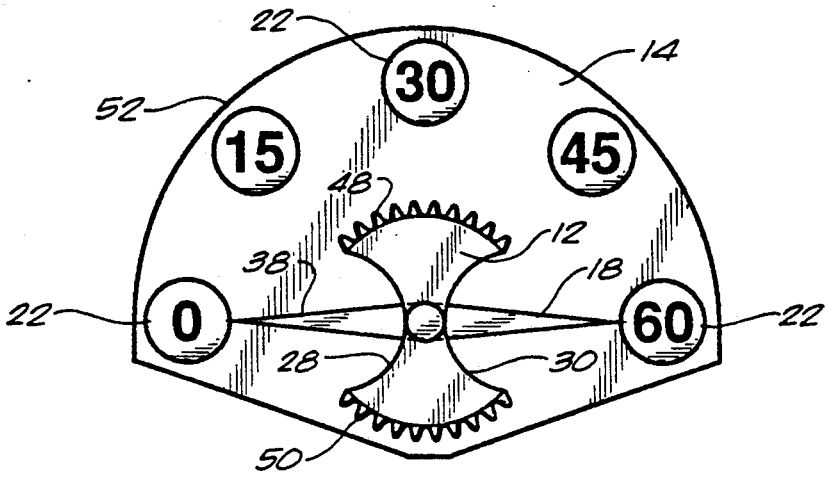
FIG. 3 illustrates the clock mechanism without the continuous band therearound.

FIG. 3 is an isolated view of the sprocket 12, the minute hands 18 and 38, and the clock dial 14. In particular, in FIG. 3, it can be seen that the receiving areas 28 and 30 have a semicircular configuration. The minute hand 18 extends centrally through the semi-circular configuration of the receiving area 30. Similarly, the minute hand 38 extends centrally through the semicircular configuration of the receiving area 28. One set of teeth 48 extends between one end of the receiving areas 28 and 30. Another set of teeth 50 extends between another end of the receiving areas 28 and 30. The clock dial 14 has a generally semi-circular configuration. The minute indicia 22 extend, in various increments, around the periphery 52 of the clock dial 14. The increments illustrated in the figures of the present application are only indicative of one arrangement of the minute numerals. In alternative embodiments of the present invention, it is possible that the clock dial 14 could have a circular configuration or a pie-section of a circle. Various arrangements of numerals 22 can also be placed on the clock dial 14 in accordance with the present invention.

Figure 4:
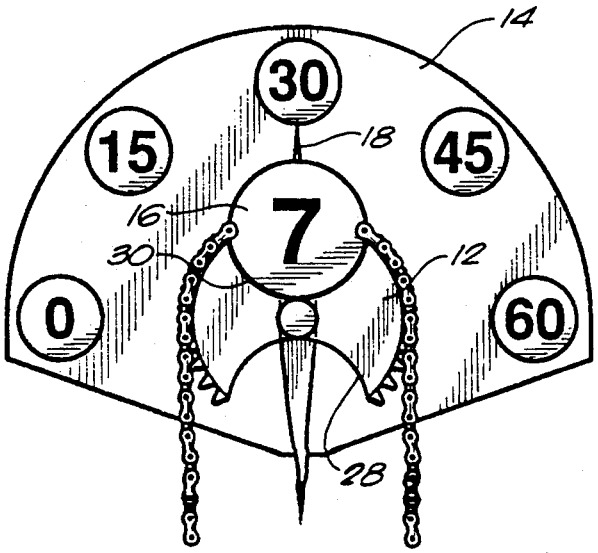
FIG. 4 is a frontal view of the clock mechanism showing the hour indicia at a different time than that shown in FIG. 1.

FIG. 4 illustrates a different position of the sprocket 12 relative to the clock dial 14. In particular, the receiving area 30 of the sprocket 12 has received an edge of the hour member 16 with the designation "7". The receiving area 28 faces downwardly so as to move into position for receiving another discoidal hour member 16. The minute hand 18 points upwardly to the minute designation "30". As can be seen in FIG. 41, the time 7:30 is illustrated.

Figure 5:
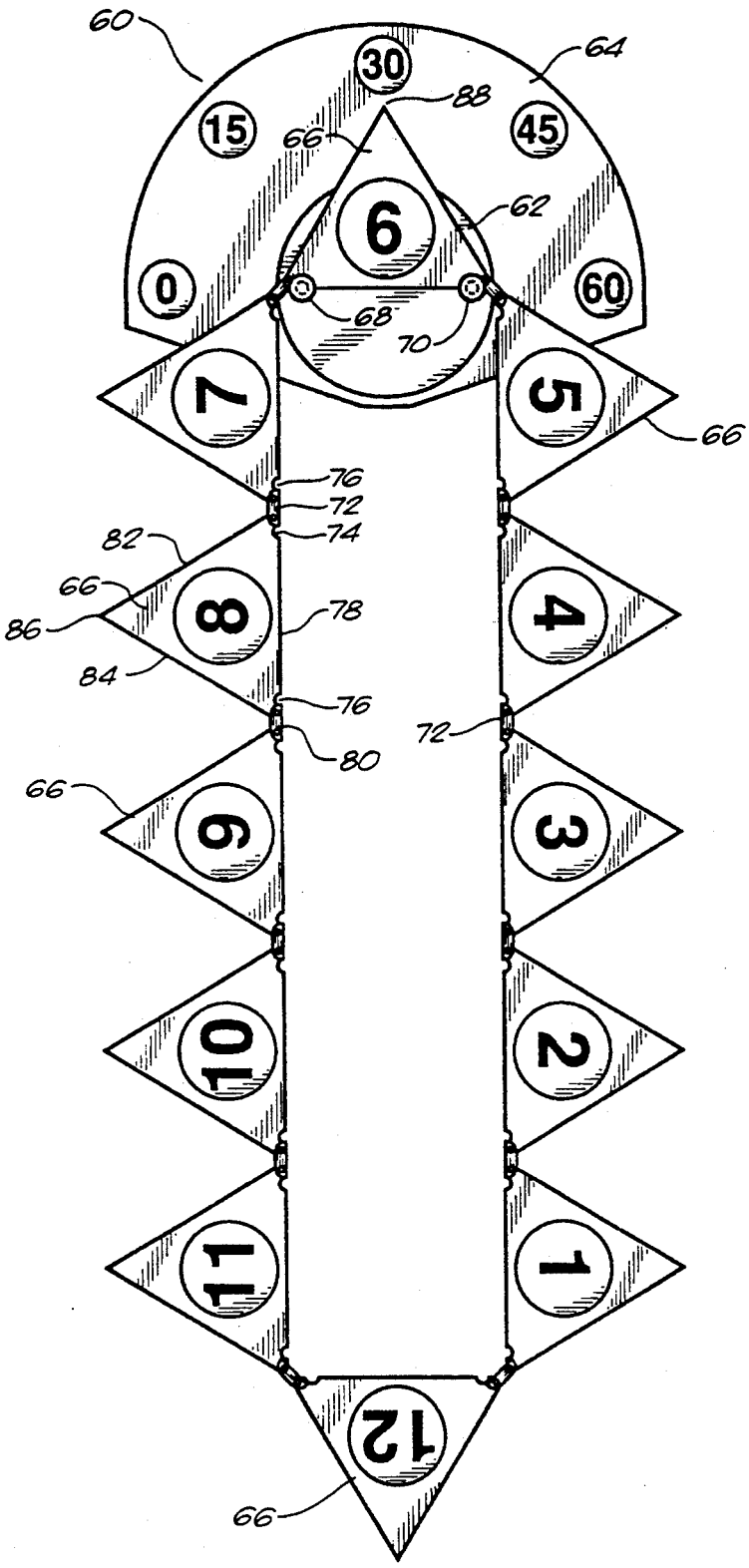
FIG. 5 is a front elevational view of an alternative embodiment of the clock of the present invention.

FIG. 5 shows the clock 60 of an alternative embodiment of the present invention. The clock 60 includes a motor (not shown), a sprocket 62, a clock dial 64, and a plurality of hour members 66. In this embodiment of the present invention, the sprocket 62 has a pair of teeth 68 and 70 extending outwardly from a face of the sprocket 62. The teeth 68 and 70 serve as the teeth of a geared member for the purposes of the present invention. The teeth 68 and 70 are spaced approximately 180 degrees from each other. The sprocket 62 has a generally circular configuration therearound. The clock dial 64 has the appearance of the clock dial of the previous embodiment.

Each of the plurality of hour members 66 has a triangular configuration. As can be seen, each of the hour members 66 is connected to an adjacent hour member by a link 72 pivotally connected to a corner of each of the triangular configurations. Each of the hour members 66 has a notch 74 and a notch 76 positioned adjacent to the link 72. With reference to the hour member 66 bearing the hour indicia "8", it can be seen that the triangular configuration has an edge 78 extending between the notches 74 and 76. Specifically, the notches 74 and 76 are formed at opposite ends of the edge 78. The link 72 is pivotally connected to a corner of the triangular configuration adjacent to notch 74. Link 80 is pivotally connected to a corner of the triangular configuration adjacent to the notch 76. Each of the hour members 66 bears this arrangement of notches and links.

Importantly, in the present invention, edges 82 and 84 extend outwardly from the edge 78 so as to form an equilateral triangle. The point 86 serves as the minute hand in this embodiment of the present invention.

In normal use,, the sprocket 62 will rotate in the manner described in conjunction with the previous embodiment. During the rotation of the sprocket 62,, the teeth 68 and 70 will engage the notches 74 and 76 formed along the edges of the continuous band of hour members 66. As can be seen in FIG. 5, the hour member 66 bearing the numeral designation "6" is received by the teeth 68 and 70. The top corner 88 is pointing to the minute designation "30". In this manner, the point 88 serves as the "minute hand" in this embodiment of the present invention. The time designated in FIG. 5 is 6:30.

Figure 6:
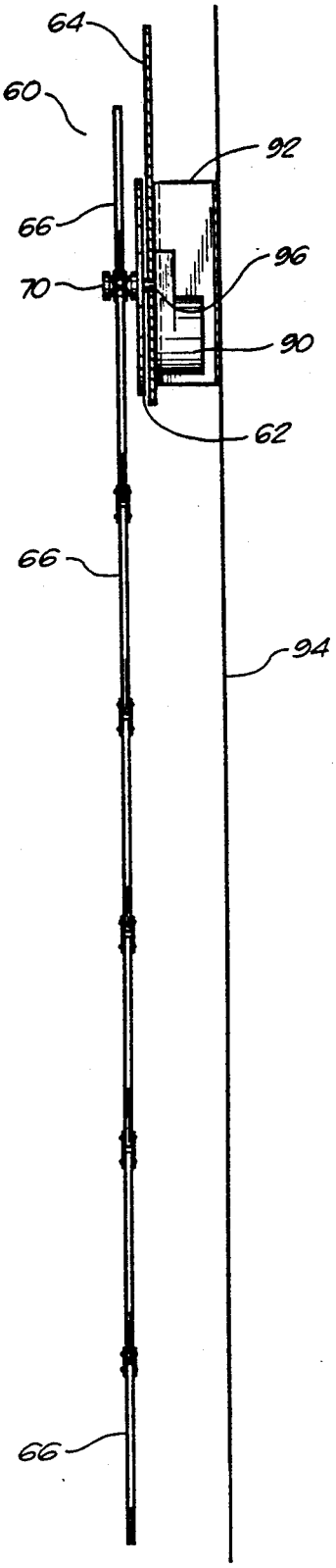
FIG. 6 is a side elevational view of the alternative embodiment of the clock of the present invention.

In FIG. 6, the alternative embodiment 60 is illustrated as having the motor 90 received within a housing 92. The housing 92 is mounted to a wall 94, for illustration. The clock dial 64 is mounted to a surface of the housing 92 opposite the wall 94. The clock dial 64 extends in parallel relationship to the wall 94. A shaft 96 extends outwardly from the motor 90 in perpendicular relationship to the clock dial 64. The sprocket 62 is mounted on the shaft 96 adjacent to the clock dial 64. The motor 90 is drivingly connected to the shaft 96 and the sprocket 62 so as to rotate the sprocket 62 at one-half revolution per hour.

Importantly, in FIG. 6, it can be seen that the gear tooth 70 extends outwardly from a surface of the sprocket 62. The gear tooth 70 has a generally hourglass configuration. The hour member 66 has its notches received centrally of the hourglass configuration of the tooth 70. The hourglass configuration of the tooth 70 serves to continually "funnel" the hour members 66, and their associated notches, into a proper position. The hour members 66 extend downwardly parallel to the wall 94 in a continuous band.

The present invention presents an attractive technique for the telling of time. The arrangement ok the continuous band of hour members creates a visually impressive arrangement. This arrangement further allows time to be told in a relatively simple and convenient manner. As long as a proper meshing of the gear teeth with the chain members occur, consistently accurate time will be determined by the clock of the present invention.

The foregoing disclosure and description of the invention is illustrative and explanatory thereof. Various changes in the details of the illustrated configuration may be made within the scope of the appended claims without departing from the true spirit of the invention. The present invention should only be limited by the following claims and their legal equivalents.

I claim:

1. A clock comprising:
a motor having a shaft extending outwardly therefrom;
a sprocket affixed to said shaft;
a clock dial positioned adjacent said sprocket, said clock dial having minute indicia displayed thereon;
a plurality of hour members being interconnected together in a form of a continuous band, said continuous band extending over a portion of said sprocket such that said plurality of hour members move relative to a movement of said sprocket; and
a minute hand interconnected to said sprocket such that said minute hand moves in relation to the movement of said sprocket.

2. The clock of claim 1, said motor positioned behind said clock dial, said shaft extending outwardly of said clock dial generally perpendicular to said clock dial.

3. The clock of claim 1, said motor drivingly connected to said shaft so as to rotate said shaft at one-half revolution per minute.

4. The clock of claim 1, said sprocket comprising:
a geared member having a plurality of teeth extending outwardly therefrom, said teeth engaging said continuous band.

5. The clock of claim 4, said sprocket further comprising:
an indented receiving area formed in said geared member, said indented receiving area conforming to a shape of said hour members.

6. The clock of claim 5, said shaft having a pair of opposing indented receiving areas formed in said geared member, each of said receiving areas having a generally semi-circular configuration.

7. The clock of claim 6, each of said hour members having a discoidal configuration, said semi-circular configuration for receiving an edge of said hour members.

8. The clock of claim 1, said clock dial having a generally semi-circular configuration, said minute indicia extending around a surface of said semi-circular configuration.

9. The clock of claim 4, said geared member having a pair of teeth extending outwardly from a face of said sprocket, said teeth spaced 180° from each other.

10. The clock of claim 4, each of said plurality of hour members being spaced from an adjacent hour member, each of said plurality of hour members connected by a chain section to an adjacent hour member, said chain section engaging said teeth of said sprocket.

11. The clock of claim 10, each of said plurality of hour members being a disk with an hour indicia displayed on a surface thereof, said plurality of hour members equally spaced apart along said continuous band.

12. The clock of claim 11, each of said plurality of hour members having a center spaced from a center of an adjacent hour member by a distance corresponding to one-half a circumference of said sprocket.

13. The clock of claim 6, said minute hand affixed to said sprocket and extending outwardly perpendicular to said shaft, said minute hand extending centrally through one of said indented receiving areas.

14. The clock of claim 13, said minute hand comprising a second minute hand extending centrally through the other of said indented receiving areas, each of the minute hands separated by 180°.

15. The clock of claim 9, said plurality of hour members having a triangular configuration, each of said hour members having a corner connected by a link to a corner of an adjacent hour member.

16. The clock of claim 15, each of said plurality of hour members having a notch formed adjacent said corner, said notch for engaging said teeth of said geared member.

17. The clock of claim 15, said minute hand being another corner of each of said hour members opposite said link.

18. The clock of claim 9, each of said pair of teeth having an hour glass configuration, said hour glass configuration having a center for receiving a portion of said continuous band.

19. A clock comprising:

a sprocket;

a motor drivingly connected to said sprocket;

a plurality of discoidal hour members interconnected together in a continuous band, said sprocket having a receiving area for receiving a portion of said continuous band, said receiving area conforming to a shape of said hour members; and a dial positioned adjacent said sprocket, said dial having minute indicia displayed thereon.

20. The clock of claim 19, further comprising:

a minute hand interconnected to said sprocket and extending outwardly therefrom, said minute hand extending through said receiving area, said minute hand having an end directed toward said minute indicia of said dial.

* * * * *